US009388521B2

(12) United States Patent
Levy

(10) Patent No.: US 9,388,521 B2
(45) Date of Patent: Jul. 12, 2016

(54) LAUNDRY SYSTEM AND METHOD

(76) Inventor: Moti Levy, Richon LeZion (IL)

( * ) Notice: Subject to any disclaimer, the term of this patent is extended or adjusted under 35 U.S.C. 154(b) by 1084 days.

(21) Appl. No.: 13/311,624

(22) Filed: Dec. 6, 2011

(65) Prior Publication Data

US 2012/0084927 A1 Apr. 12, 2012

Related U.S. Application Data

(63) Continuation-in-part of application No. PCT/IB2009/052427, filed on Jun. 8, 2009.

(51) Int. Cl.
*D06F 35/00* (2006.01)
*D06F 31/00* (2006.01)

(52) U.S. Cl.
CPC ..... *D06F 35/00* (2013.01); *D06F 31/00* (2013.01)

(58) Field of Classification Search
CPC ..... D06F 35/00
See application file for complete search history.

(56) References Cited

U.S. PATENT DOCUMENTS

| | | | | |
|---|---|---|---|---|
| 2,366,136 | A | 12/1944 | Waldstein | |
| 2,530,494 | A | 11/1950 | Vigerust | |
| 6,267,124 | B1 | 7/2001 | Bowden | |
| 2004/0000174 | A1 * | 1/2004 | Bolduan et al. | 68/5 D |

FOREIGN PATENT DOCUMENTS

| | | |
|---|---|---|
| DE | 3046733 | 7/1982 |
| DE | 10064548 | 6/2002 |
| GB | 1158483 | 8/1966 |
| GB | 1244467 | 4/1970 |
| GB | 1263273 | 2/1972 |
| JP | 1284294 | 5/1990 |
| WO | 02/052088 | 7/2002 |

* cited by examiner

*Primary Examiner* — Jason Ko
(74) *Attorney, Agent, or Firm* — Mark David Torche; Patwrite LLC

(57) ABSTRACT

The invention relates to a system and a method taking advantage of the cleaning effect of pressurized cleaning fluid, typically water; and in a continuous process. Accordingly, a stream of cleaning fluid is generated and applied to the laundry via one or more nozzles, as the laundry passes by the nozzles. Advantages of the laundry system and method, without limitation, may include the following: (a) the system generally saves water, time and electricity; (b) washing time depends on the size of each laundry item; (c) there is no need to accumulate laundry rather it is efficient to wash even just one or a few laundry items; (d) there is no need to sort laundry items; and (e) using high pressure water may require less or no soap, thereby causing less pollution and saving money.

9 Claims, 4 Drawing Sheets

LAUNDRY SYSTEM AND METHOD

CROSS-REFERENCE TO RELATED PATENT APPLICATIONS

This application is a continuation in part of International Application No. PCT/IB2009/052427, titled "Laundry system and method", filed on Jun. 8, 2009.

FIELD OF THE INVENTION

The present invention relates to laundering clothing, and more specifically to a high pressure laundering method and system therefor.

BACKGROUND OF THE INVENTION

A washing machine generally operates by subjecting the laundry to water and detergent and mechanically agitating the laundry, typically in a revolving drum or other container. Laundering is carried out according to a programmed schedule, whereby the laundry is typically mixed with water of a specified temperature and chemicals (e.g. detergent, laundry softener, brighteners, etc.) at various times and cycles of actions (e.g., rinsing, adding fabric softener, spin drying and so forth). Laundry can encompass a wide range of fabrics and may sometimes include other material(s).

GB patent 1263273 describes a method of continuously and rapidly rinsing cleansing solution from fabric articles including: transporting the articles along a predetermined path, repeatedly rinsing the articles at spaced apart locations along the predetermined path and simultaneously introducing gas into the rinse liquid to form a mixture that is forced under pressure through the articles.

SUMMARY OF THE INVENTION

It is an object of the present invention to provide a laundering system and method wherein the laundry is efficiently washed either in terms of time and/or cleaning quality.

The invention relates to a system and a method taking advantage of the cleaning effect of pressurized cleaning fluid, typically water; and in a continuous process (versus a batch process). Accordingly, a stream of cleaning fluid is generated and applied to the laundry via one or more nozzles, as the laundry passes by the nozzles.

Advantages of the laundry system and method, without limitation, may include one or more of the following: (a) the system generally saves water, time and electricity as compared to a conventional laundry machine, as each period of laundering action is not pre-programmed rather depends on the number of laundry items that are washed; (b) washing time depends on the size of each laundry item and typically requires less than a minute per laundry item; (c) there is no need to accumulate laundry as in a conventional batch washing machines rather it is efficient to wash even just one or a few laundry items; (d) there is no need to sort laundry items—different colored clothing and fabric types such as, delicate and rough fabrics can be cleaned one after the other; and (e) using high pressure water may require less or no soap, thereby causing less pollution and saving money.

It is a particular feature of the laundry system and method that water/cleaning fluid is sprayed on the laundry with a pressure/intensity whereby the laundry is rapidly and efficiently cleaned.

BRIEF DESCRIPTION OF THE DRAWINGS

The invention will be understood and appreciated more fully from the following detailed description taken in conjunction with the appended drawings in which.

The following detailed description of embodiments of the invention refers to the accompanying drawings referred to above. Wherever possible, the same reference numbers will be used throughout the drawings and the following description to refer to the same and like parts.

DETAILED DESCRIPTION OF THE INVENTION

Figure 1:
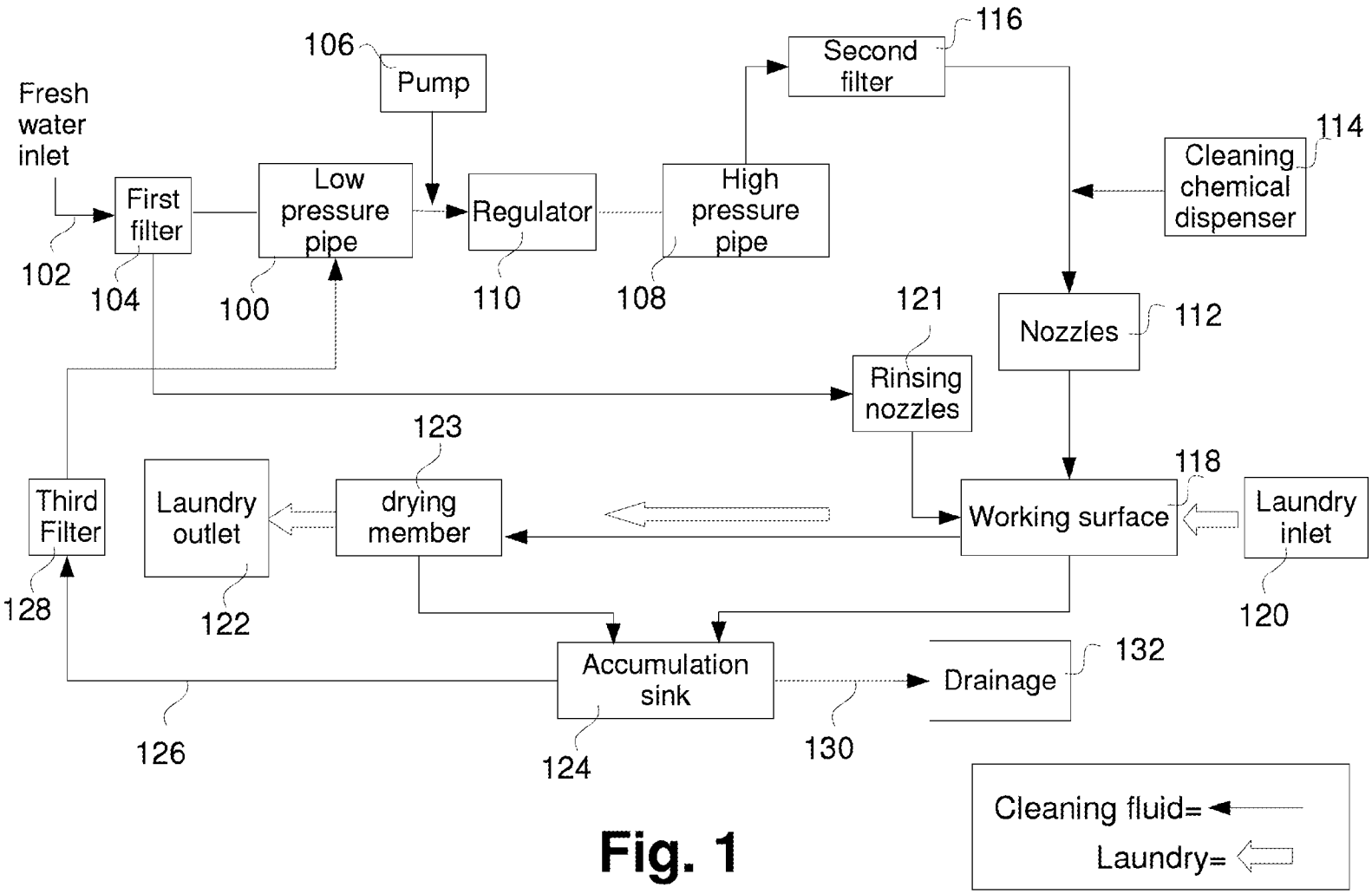
FIG. 1 is a block diagram schematically showing an embodiment of a laundry machine in accordance with the present invention.

FIG. 1 shows an embodiment of a laundry system in accordance with the present invention. The system comprises a low pressure pipe 100 having a fresh water inlet 102 via which a source of water enters, such as from a water container or municipal water source (not shown). At inlet 102, a first filter 104 is disposed to ensure the water is properly cleaned prior to entering the laundering system. Pipe 100 is typically made of metal or plastic; or other suitable plumbing material. Along pipe 100, a pump 106 is installed for producing a pressurized water flow, which is fed into a high pressure pipe 108. In some embodiments, the system includes a pressure regulator 110, integrated with or downstream of pump 106. One or more nozzles 112 are located at the discharge end of high pressure pipe 108.

Typically, the system includes one or more inlets 114 for introducing cleaning and softening chemicals. Inlet 114 is illustrated as upstream and adjacent nozzles 112, however, the inlet could be located at a variety of locations including adjacent fresh water inlet 102. A second filter 116 is typically disposed upstream of inlet 114 and nozzles 112. The water, or mixture of water and cleaning chemicals, is discharged in the form of a high-flow spray or jet from nozzles 112.

Figure 2:
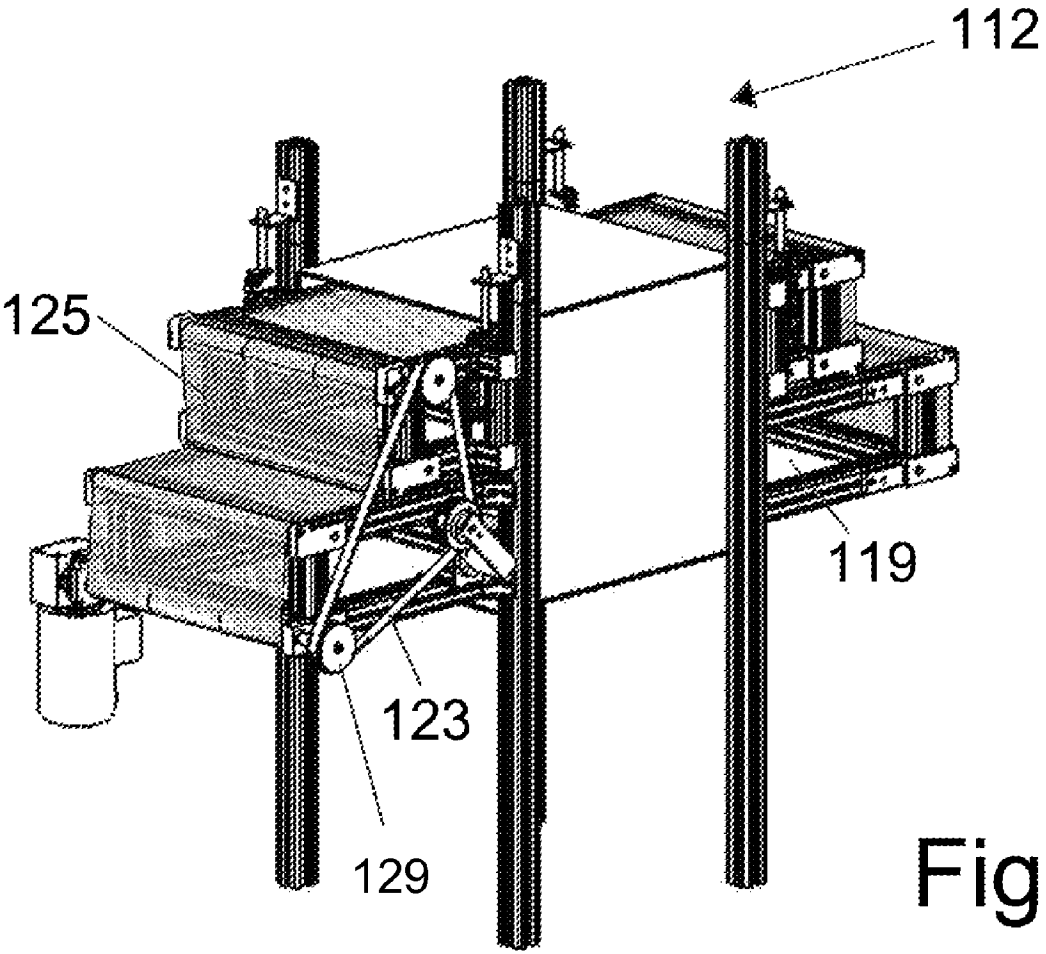
FIG. 2 depicts an embodiment of the laundry machine having a working surface associated with a conveying means.

As shown in FIG. 2, the system further comprises a working surface 118 typically having, or associated therewith, a conveying means, including for example a conveyor belt 119 activated by cogwheels 129 and a cog belt 123. Laundry is placed at a laundry inlet 120 (FIG. 1) which directs the laundry toward working surface 118. The laundry is held to working surface 118, by a laundry holding mechanism, for example, by one or more nets 125 or via a pair of conveyor belts having associated therewith the nets. Laundry items (not shown) are held between conveyor belt 119 and net 125.

It is a particular feature of the invention that for providing improved and/or more efficient laundering, nozzles 112 are disposed above and below working surface 118, to ensure an all-around laundering to each piece of laundry. In such case, working surface 118 is porous or has apertures 131 (FIG. 3C) whereby the cleaning fluid can pass through the working surface and can thoroughly contact the laundry. In particular embodiments, nozzles 112 are adapted to disperse the water/cleaning fluid at various pressures and to be orientable at a variety of angles relative to working surface 118, to suit the type of fabrics and stains to be laundered.

Figure 3A:
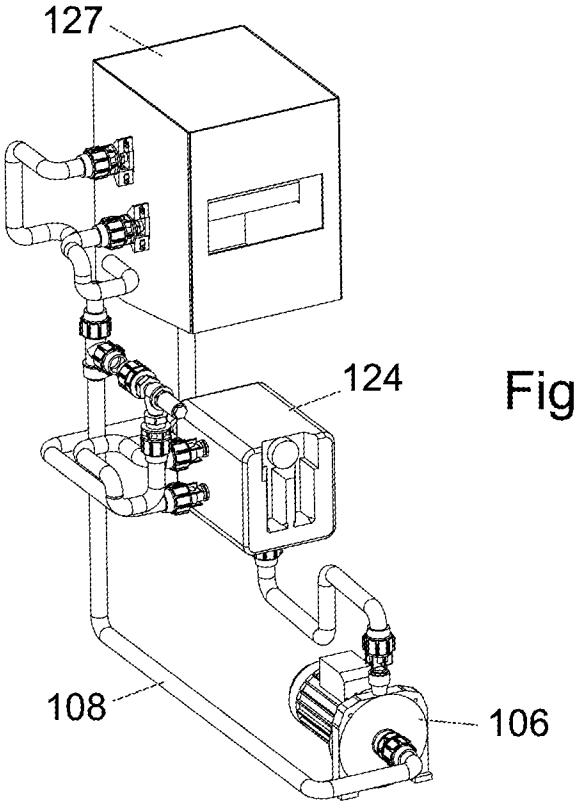
FIGS. 3A, 3B and 3C show an embodiment of the laundry machine adapted for home use.
Figure 3B:
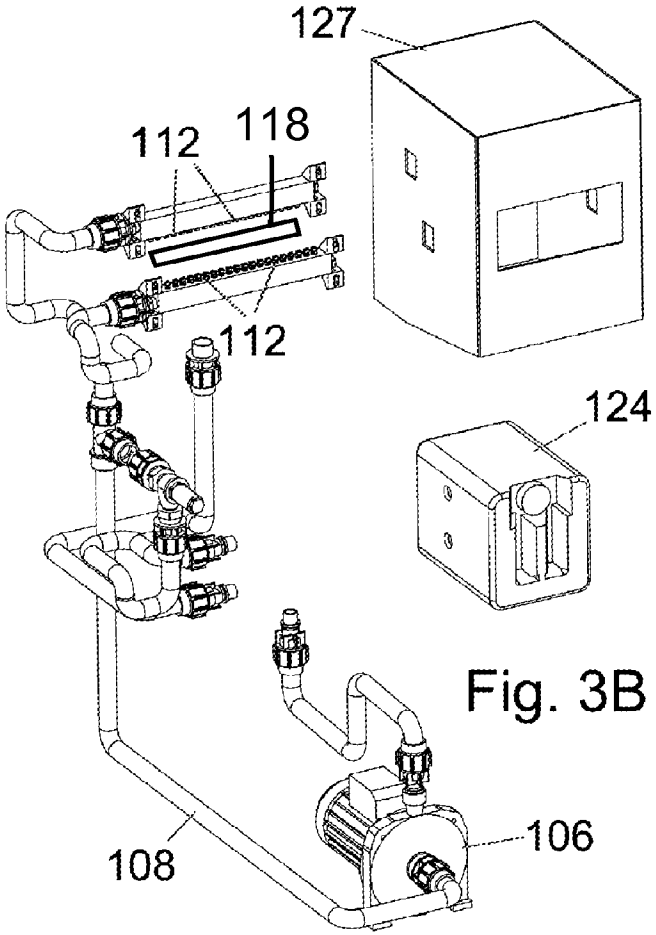
Figure 3C:
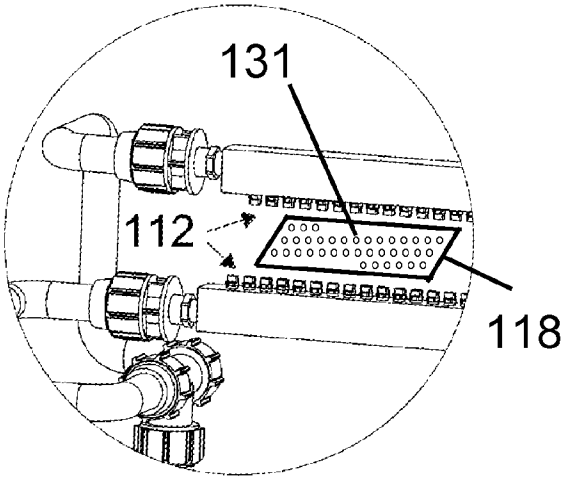

FIGS. 3A and 3B show an exemplary laundry machine adapted for home use. High pressure pipe 108 conveys the cleaning fluid pressurized by pump 106 and delivered to two opposing sets of nozzles 112. A laundry housing 127 is connected to an accumulation tank 124 via a recycle pipe 130. As seen more clearly in FIG. 3C, nozzles 112 are disposed above and below working surface 118. Alternatively, nozzles 112 can be arranged differently, for example, at each side of working surface 118. In cases where chemical cleansers are added, one or more set of rinsing nozzles 121 are typically disposed above and below working surface 118, to remove soap from the laundry items. Rinsing nozzles 121 typically discharge water at a lower pressure and/or flow rate, as compared to nozzles 112 (however without limitation). At the distal end of working surface 118, clean laundry is delivered to laundry outlet 122 of the laundry system.

In some embodiments, the system includes a water removal mechanism 123, for example a rotatable cylinder, roller, hot air blower, or combination thereof, etc), disposed downstream of working surface 118. Laundry moving along working surface 118 is at least partially dried by drying mechanism 123.

In other embodiments, the system comprises a water recycle loop to allow reuse of at least a portion of the used water. The loop includes a water accumulation sink 124 beneath working surface 118; and a water recycle pipe 126 that directs water through a third filter 128 and back to low pressure pipe 100. A waste pipe 130 discharges residue water from nozzles 112, working surface 118, rinsing nozzles 121 and drying mechanism 123 into municipal drainage 132.

As mentioned above, according to some embodiments, working surface 118 includes a conveying mechanism to transport the laundry, and which can be via a variety of means, such as via vibration, pneumatically, a conveyor belt, and so on. In one embodiment, nozzles 112 are oriented at a particular fixed angle, which is suitable for a wide range of fabric types, including delicate fabrics and rougher fabric types. As a result laundry pieces subjected within the laundry system can be cleaned without sorting.

According to an embodiment of the laundry method, the present invention provides a laundering method including the steps of placing one or more laundry items, either manually or automatically, on working surface 118; and applying high pressure water, with or without cleaning/softening chemicals, to the laundry on the working surface, discharged from one or more nozzles. In some embodiments, where cleaning chemicals are added to the water, the method further includes a rinsing step, whereby a rinsing fluid from one or more rinsing nozzles 121 is sprayed onto the laundry items.

Testing:

Laundry experiments in accordance with method of the present invention were performed using various fabric types and colors (see Table 1), in order to determine desired intensity and angle of incidence of the cleaning fluid. Prior to entering the laundry system, fabrics were stained with different kinds of dirt and food products, such as, ketchup, red wine, oil, mud, chocolate and concentrated pomegranate juice. A stain remover, "Sano-oxygen" [Sano Bruno's Enterprises, Ltd, Neve-Neeman Industrial Zone, Hod-Hasharon, Israel 54241], was dispensed into cleaning chemical inlet 114, and then the laundry system was operated. The intensity of the water/cleaning fluid, which was defined by flow rate and area of incidence of the water/cleaning fluid, was tested in order to determine an intensity range resulting in a suitable balance between proper cleaning and minimal damage to the laundry items for a variety of fabric colors and types. A suitable range of nozzle angles, defined as the angle between the nozzles 112 and working surface 118, was also determined for a suitable balance between proper cleaning and minimal damage to the laundry items. A suitable combination of intensity and angles of incidence was found to be 1-6 meters per second and 70-90 degrees, respectively.

It should be noted that, the angle is not restricted to any angle and can be variable with respect to the fabric and stains to be cleaned.

TABLE 1

Tested fabric compositions/types:

| Fabric composition | Fabric type | Fabric colors |
|---|---|---|
| 100% cotton | fabric | Azure, white, yellow, violet, black, green |
| 100% cotton | knitted dress | Green |
| 100% cotton | Corduroy | Black |
| 100% cotton | Jeans | Blue |
| 92% cotton, 8% Lycra | Fabric | Violet |
| 65% cotton, 35% polyester | Fabric | Gray with brown pattern |
| 100% polyester | Pelisse | Brown |
| 95% viscose, 5% elastan (spandex) | Fabric | Gray |

What is claimed is:

1. An apparatus for laundering laundry items with a cleaning fluid, comprising:

an inlet pipe for the cleaning fluid;

a pump associated with said inlet pipe for increasing the pressure of said cleaning fluid;

a working surface configured to receive the laundry items; and at least two nozzles configured to discharge said cleaning fluid, directed toward the working surface for discharging cleaning fluid to wash said laundry items, wherein at least one nozzle is disposed above and at least one nozzle is disposed below the working surface, which has associated therewith a laundry holding mechanism comprising a net configured to cover the laundry items and secure the laundry items to the working surface and the working surface is porous or comprises through-holes.

2. The apparatus according to claim 1, wherein at least one filter is disposed upstream of said pipe and/or said nozzles.

3. The apparatus according to claim 1, further comprising a recycle loop having; a water accumulation sink disposed beneath said working surface; a recycle pipe for directing water back to said recycle loop; and a waste pipe for discharging residue water into municipal drainage.

4. The apparatus according to claim 3, wherein at least one filter is disposed downstream of the recycle pipe.

5. The apparatus according to claim 1, wherein said pump further comprises a pressure regulator integrated with or downstream of said pump.

6. The apparatus according to claim 1, further comprising at least one inlet for receiving cleaning chemicals upstream of said nozzles; and at least one rinsing nozzle, for rinsing said laundry items.

7. The apparatus according to claim 1, wherein said work surface comprises a laundry conveying means.

8. The apparatus according to claim 1, wherein said working surface further comprises a water removal mechanism, for at least partially drying the laundry.

9. The apparatus according to claim 1, wherein the nozzles are configured to discharge the cleaning fluid at an intensity range of 1-6 meters per second and be oriented at 70-90 degrees relative to said working surface.

* * * * *